US010246823B2

(12) United States Patent
Hall et al.

(10) Patent No.: US 10,246,823 B2
(45) Date of Patent: Apr. 2, 2019

(54) COMPRESSIBLE ROPE

(71) Applicants: David R. Hall, Provo, UT (US); Jerome Miles, Spanish Fork, UT (US); Benjamin Taylor, Provo, UT (US); Joe Fox, Spanish Fork, UT (US); Lloyd J. Wilson, Herriman, UT (US)

(72) Inventors: David R. Hall, Provo, UT (US); Jerome Miles, Spanish Fork, UT (US); Benjamin Taylor, Provo, UT (US); Joe Fox, Spanish Fork, UT (US); Lloyd J. Wilson, Herriman, UT (US)

(73) Assignee: Hall Labs LLC, Provo, UT (US)

( * ) Notice: Subject to any disclaimer, the term of this patent is extended or adjusted under 35 U.S.C. 154(b) by 331 days.

(21) Appl. No.: 15/245,833

(22) Filed: Aug. 24, 2016

(65) Prior Publication Data

US 2018/0010296 A1 Jan. 11, 2018

Related U.S. Application Data

(60) Provisional application No. 62/360,563, filed on Jul. 11, 2016.

(51) Int. Cl.

| | |
|---|---|
| ***D07B 1/04*** | (2006.01) |
| ***D07B 5/00*** | (2006.01) |
| ***D07B 1/16*** | (2006.01) |

(52) U.S. Cl.

CPC ..... *D07B 5/005* (2013.01); *D07B 1/04* (2013.01); *D07B 1/162* (2013.01); *D07B 5/00* (2013.01); *D07B 2201/1012* (2013.01); *D07B 2201/2007* (2013.01); *D07B 2201/209* (2013.01); *D07B 2201/2021* (2013.01); *D07B 2401/205* (2013.01)

(58) Field of Classification Search

CPC ... D07B 1/02; D07B 1/04; D07B 1/06; D07B 1/0613; D07B 1/062; D07B 1/068; D07B 1/0686; D07B 1/0693; D04C 1/12; D04C 1/06

See application file for complete search history.

(56) References Cited

U.S. PATENT DOCUMENTS

| | | | | |
|---|---|---|---|---|
| 4,640,178 A * | 2/1987 | Kurzbock | D07B 1/02 | 87/1 |
| 5,301,595 A * | 4/1994 | Kessie | F16J 15/22 | 277/651 |
| 5,911,675 A * | 6/1999 | Obana | D07B 1/064 | 152/451 |
| 2010/0162882 A1* | 7/2010 | Shakespeare | A62B 1/16 | 87/6 |
| 2011/0197564 A1* | 8/2011 | Zachariades | B32B 5/26 | 57/210 |

* cited by examiner

*Primary Examiner* — Tajash D Patel

(57) ABSTRACT

A compressible rope is disclosed comprising a plurality of strands. Interconnected outer strands form a sheath, and one or more inner strands form an inner core encased by the sheath. The inner core comprises a non-planar outer surface in contact with the sheath. The strands may be a monofilament or polyfilament material. The interaction between the non-planer outer surface of the core with the interior surface of the sheath can reduce bunching as well as the separation of the strands due to compressional forces.

20 Claims, 7 Drawing Sheets

COMPRESSIBLE ROPE

CROSS-REFERENCE TO RELATED APPLICATIONS

This application claims the benefit of U.S. Provisional Application No. 62/360,563 filed Jul. 11, 2016, the contents of the application being incorporated herein by reference.

TECHNICAL FIELD

The present disclosure relates generally to the field of cordage. More specifically, the present disclosure relates to an improved rope.

BACKGROUND

Rope-type cordage is often used in environments where it is desirable to transmit high tensile forces to move things such as elevator cars, elements, of cranes, draglines, and other lifting or pulling devices. The desirable characteristics of ropes that enable rope to transmit such high tensile forces can, in some instances, result in one or more drawbacks or may perform less than optimally in one or more respects. When used in a mechanized winch, a rope can be subjected not only to the tensile forces typical of rope use, but also compressional forces necessary to maintain a tight coil around the winding spool. Such compressional forces can result in bulges or separation of the rope, which may disrupt the desired coiling effect. Embodiments disclosed herein provide improvements to existing rope technologies such that there is a reduction in the typical bunching and separation caused by compression of the rope.

BRIEF DESCRIPTION OF THE DRAWINGS

The written disclosure herein describes illustrative embodiments that are non-limiting and non-exhaustive. Reference is made to certain of such illustrative embodiments that are depicted in the figures, in which.

DESCRIPTION

Figure 1A:
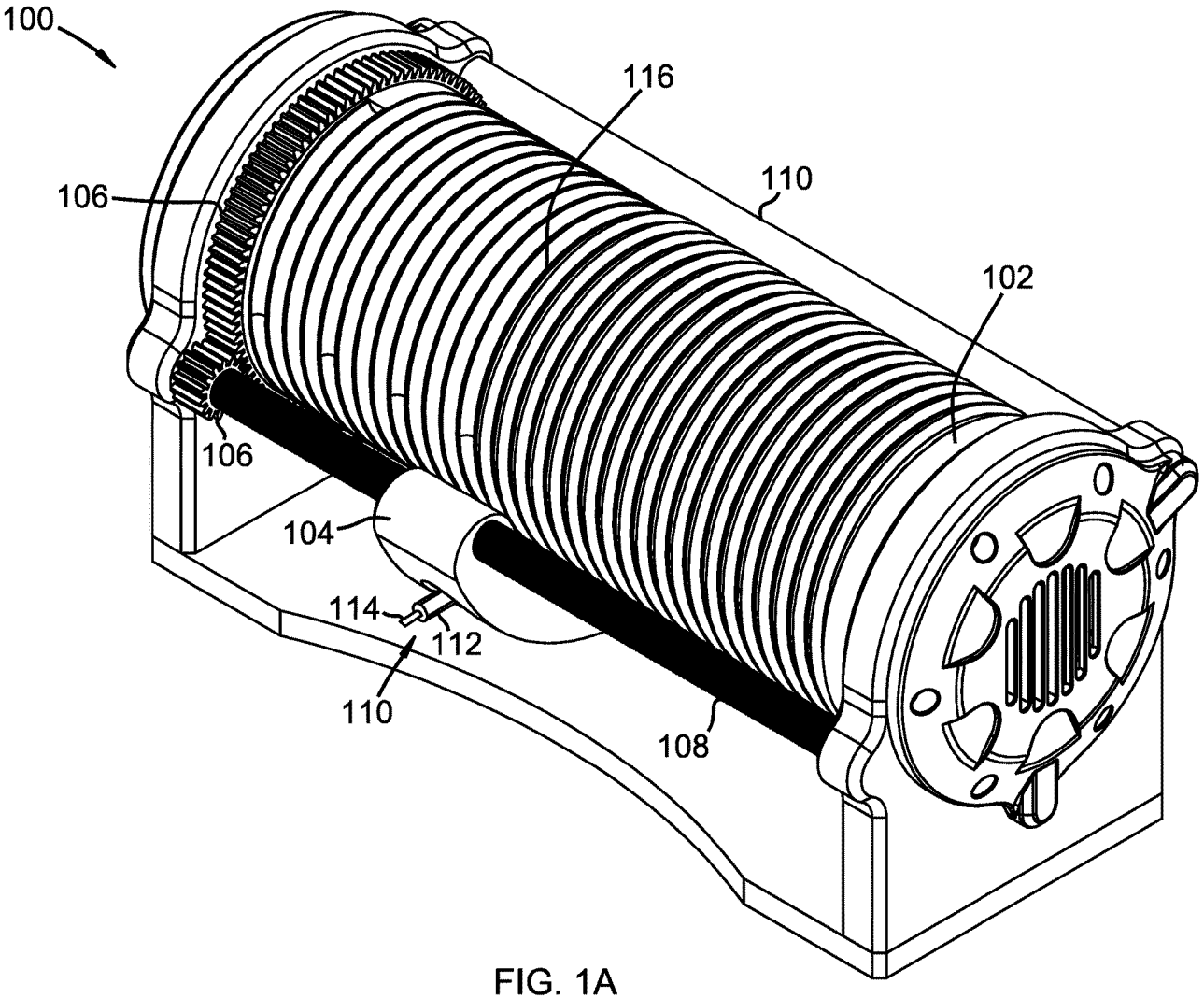
FIG. 1A is a representation of a mechanical winch with a rope, according to one embodiment.

A compressible rope may include an outer sheath surrounding an inner core, wherein the inner core includes a non-planar outer surface at least partially along its length that is in contact with the inner surface of the outer sheath. A mechanical winch may be used to let out or draw in a rope or line from a drum. To feed out the rope, the winch can put the rope under compressional forces. Such compressional forces can induce unraveling, separating, or bulging of either the inner or outer strands of rope. As a result of the separating strands, the rope can become tangled and the winch can become jammed. Such jamming can result not only disrupting the functional aspects of the winch, but can also decrease the longevity of the rope by creating snags or tears in the rope material. In various embodiments, the non-planar surface of the inner core provides sufficient resistance to reduce the aforementioned separation of the strands. As a result of decreasing the likelihood of the strands separating, the rope is less likely to get tangled and the winch is less likely to jam.

In various embodiments, the rope may include one or more materials such as hemp, linen, flax, cellulose, carbon, wool, hair, feathers, cotton, coir, jute, straw, silk, sisal, polymers, nylon, Dyneema®, Kevlar®, rayon, orlon, polypropylene, polyesters, polyethylene, aramids, acrylics, copper, iron, steel, stainless steel, bronze, nichrome, carbon, solder, titanium, zinc, silver, gold, tungsten, or aluminum. In various embodiments, the inner core comprises discontinuities at random or periodic locations along the length of the rope that can correspond with or be unrelated to any change in the material composition of the inner core.

According to various embodiments, a sheath can be comprised of a plurality of tied, knotted, looped, twisted, braided, or woven outer strands, or combinations thereof. In some embodiments, the sheath may encase the core while the core is under tension. Various embodiments of the outer sheath may include strand patterns or interactions that are distributed uniformly along the length of the rope. In other embodiments, the strands of the outer sheath may have discontinuities in the patterns or interactions at random or periodic locations along the length of the rope corresponding with or unrelated to any change in the material composition of the sheath. The outer sheath, according to some embodiments, may include rings, loops, bands, knots, or circles.

As described herein, an inner core may include a single strand or a plurality of strands. Additionally, according to various embodiments, the inner core may include a monofilament or polyfilament material, or a combination thereof. In various embodiments, one or more inner strands can be tied, knotted, looped, twisted, braided, woven, or any combination thereof. In various embodiments, one or more inner strands are tied, knotted, looped, twisted, braided, or woven uniformly along the length of the core. In other embodiments, the pattern or interconnections of the inner core strands have a discontinuous distribution along the length of the rope. Various embodiments may include discontinuities that correspond with or are unrelated to any change in the material composition of the inner core. The inner core, according to various embodiments, may be under tension after being encased by the sheath.

Various embodiments of the inner core may include a roughened or non-planar surface at least partially along its length. The non-planar surface may comprise a plurality of undulations, spirals, depressions, perforations, excrescences, protrusions, protuberances, or papillae. The non-planar surface can occur periodically, measuredly, irregularly, or sporadically along at least a portion of the inner core.

Some embodiments may include a non-planar surface that is comprised of a plurality of inconsistencies such as knots, bulges, swellings, or lumps at least partially along the length of rope. The inconsistencies created by knots, bulges, swellings, or lumps may be due to a relatively thicker material, tangled masses associated with knots, loosely woven strands, or combinations thereof. Various embodiments may also include an inner core comprising one or more rings, loops, bands, or circles distributed intermittently along the non-planar surface.

As presented herein, the interaction between the sheath and the inner core may be static or dynamic depending on the materials used, the distribution of any discontinuities, or other characteristics made possible by having a non-planar inner core. This interaction may reduce in the occurrence of unintended bunching, untying, separating, or slipping between the sheath and the inner core at least partially along the length of the rope.

It will be readily understood that the components of the embodiments as generally described and illustrated in the figures herein could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

Cordage may also be referred to herein as a "rope" and may refer to any rope, line, cord, or cable that can be used for dragging or lifting. The term "strand" is broad enough to refer to any suitable fiber, filament, thread, yarn, wire, or any other threadlike material. Multiple strands combine to form a sheath around a core. The term "sheath" may refer to any close-fitting case or covering. The term "core" is used in its ordinary sense, and is broad enough to refer to the central or innermost portion of a rope.

Some embodiments can be particularly suited to function with the assistance of a mechanical winch to drag or lift an object. In the following disclosure, the phrase "mechanical winch" generally refers to a mechanical device that uncoils or coils cordage.

FIG. 1A is a representation of a mechanical winch 100 with a rope 110, according to one embodiment. The mechanical winch 100 includes a drum 102 for coiling a rope 110. The mechanical winch 100 also includes a guiding mechanism 104 for guiding the rope 110 onto or off of the drum 102. Motorized gears 106 operate to rotate the drum 102 such that it can draw in or let out the rope 110. As the rope 110 is being drawn in or let out, the guiding mechanism 104 can move along a dial 108 such that there is a uniform distribution of the rope 110 as it coils around the drum 102. The rope 110 includes an outer sheath 112 and an inner core 114. This rope 110 is cut in a manner so as to illustrate the two layers of the rope 110.

Figure 1B:
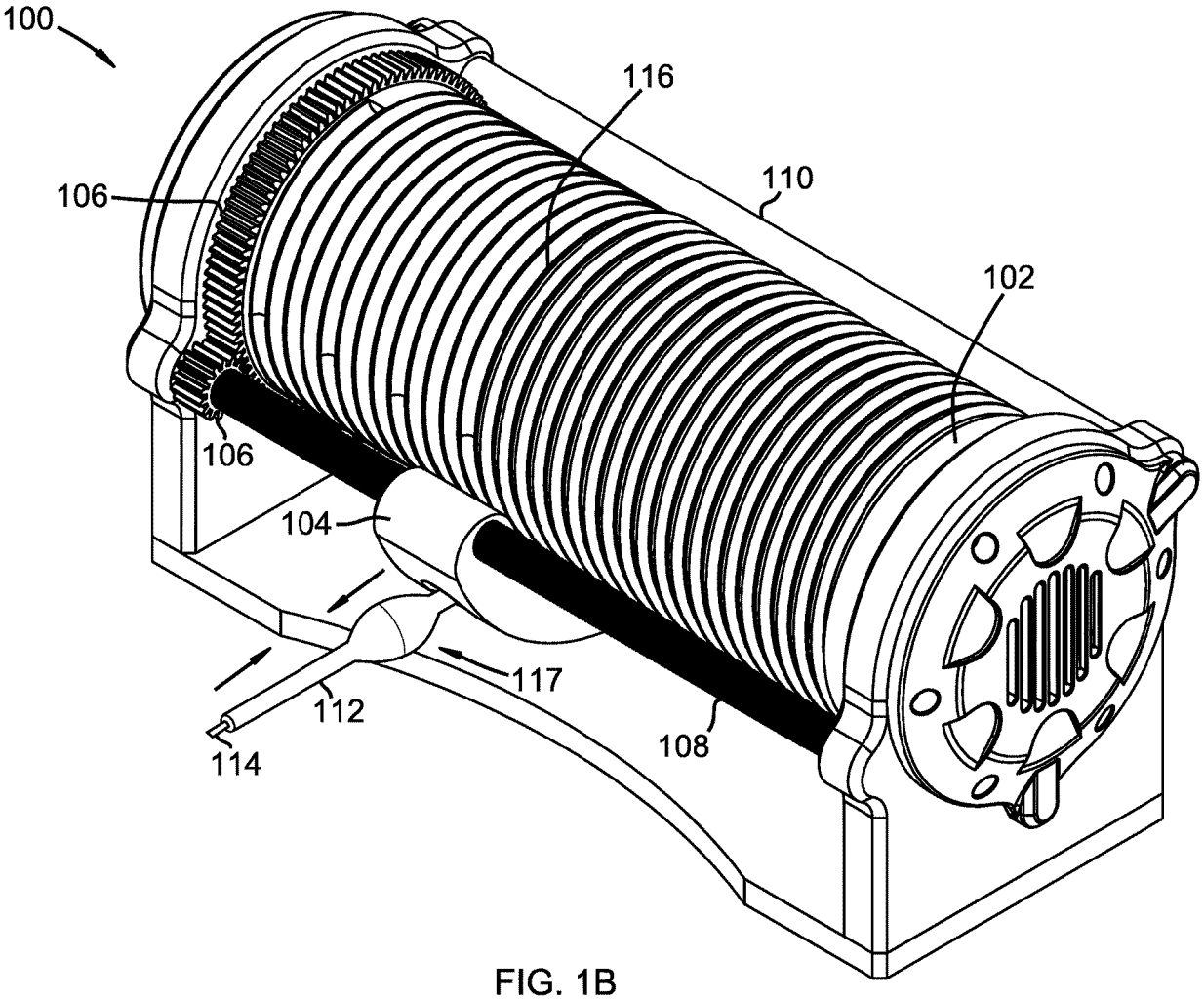
FIG. 1B illustrates the mechanical winch of FIG. 1A, with bulging of the rope near the guiding mechanism.

FIG. 1B illustrates the mechanical winch 100 of FIG. 1A, with bulging 117 of the rope 110 near the guiding mechanism 104. The bulging 117 can be induced when the rope 110 is subjected to compressional forces as the rope 110 is being let out. The bulging 117 can cause the rope to become tangled and/or caught in the guiding mechanism 104 resulting in a jammed mechanical winch 100.

Figure 2:
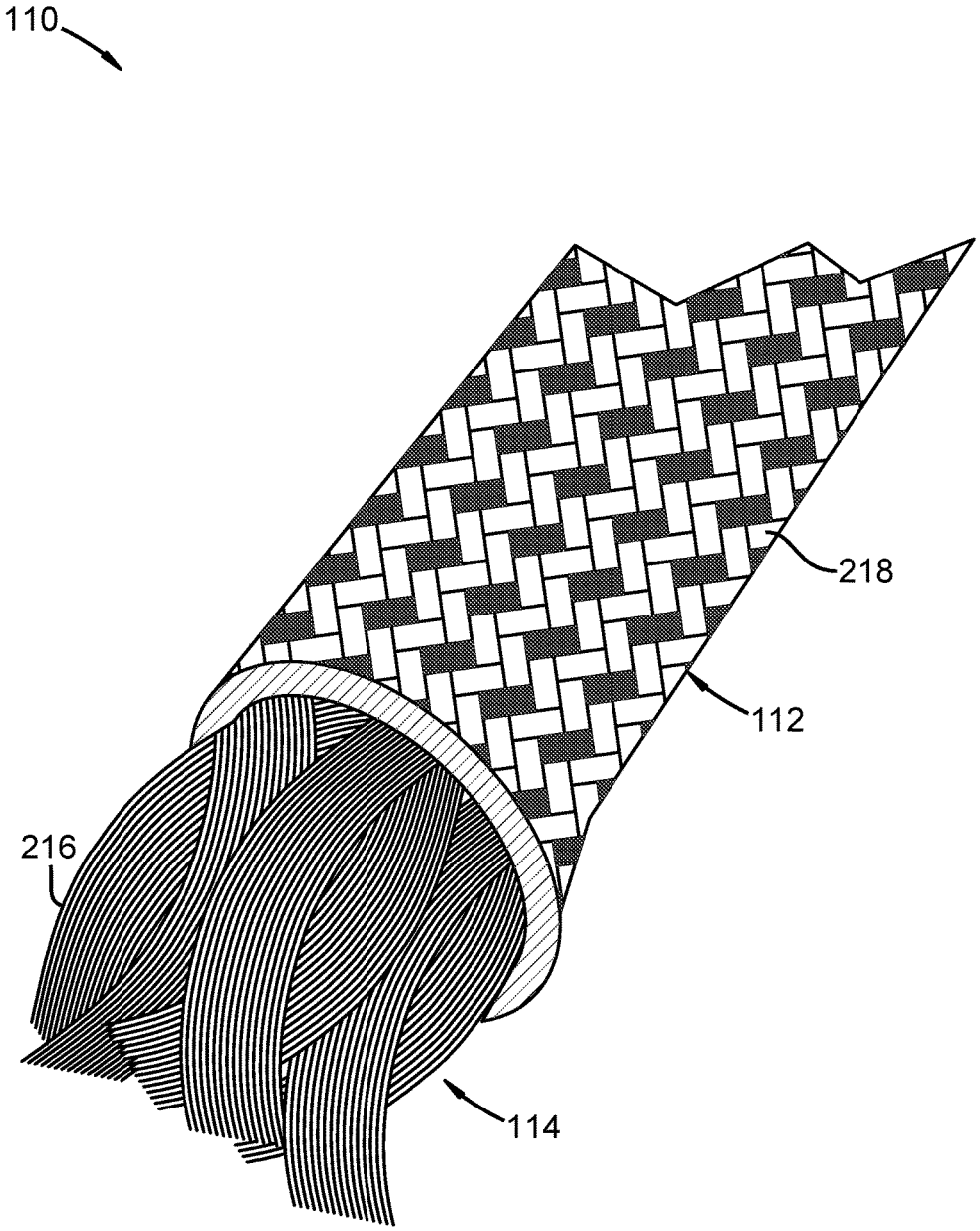
FIG. 2 is a magnified view of the rope of FIG. 1A with an inner core and outer sheath according to one embodiment.

FIG. 2 is a magnified view of the rope 110 of FIG. 1, with an inner core 114 and outer sheath 112 according to one embodiment. The outer sheath 112 includes a plurality of braided strands 218, but such strands 218 can be tied, knotted, looped, twisted, or woven as well. In various embodiments, the inner core 114 may include one or more inner stands 216 that are of a monofilament or polyfilament material. The inner strands 216 of the present embodiment are depicted as being twisted, but can also be tied, knotted, looped, braided, or woven, or any combination thereof.

Figure 3:
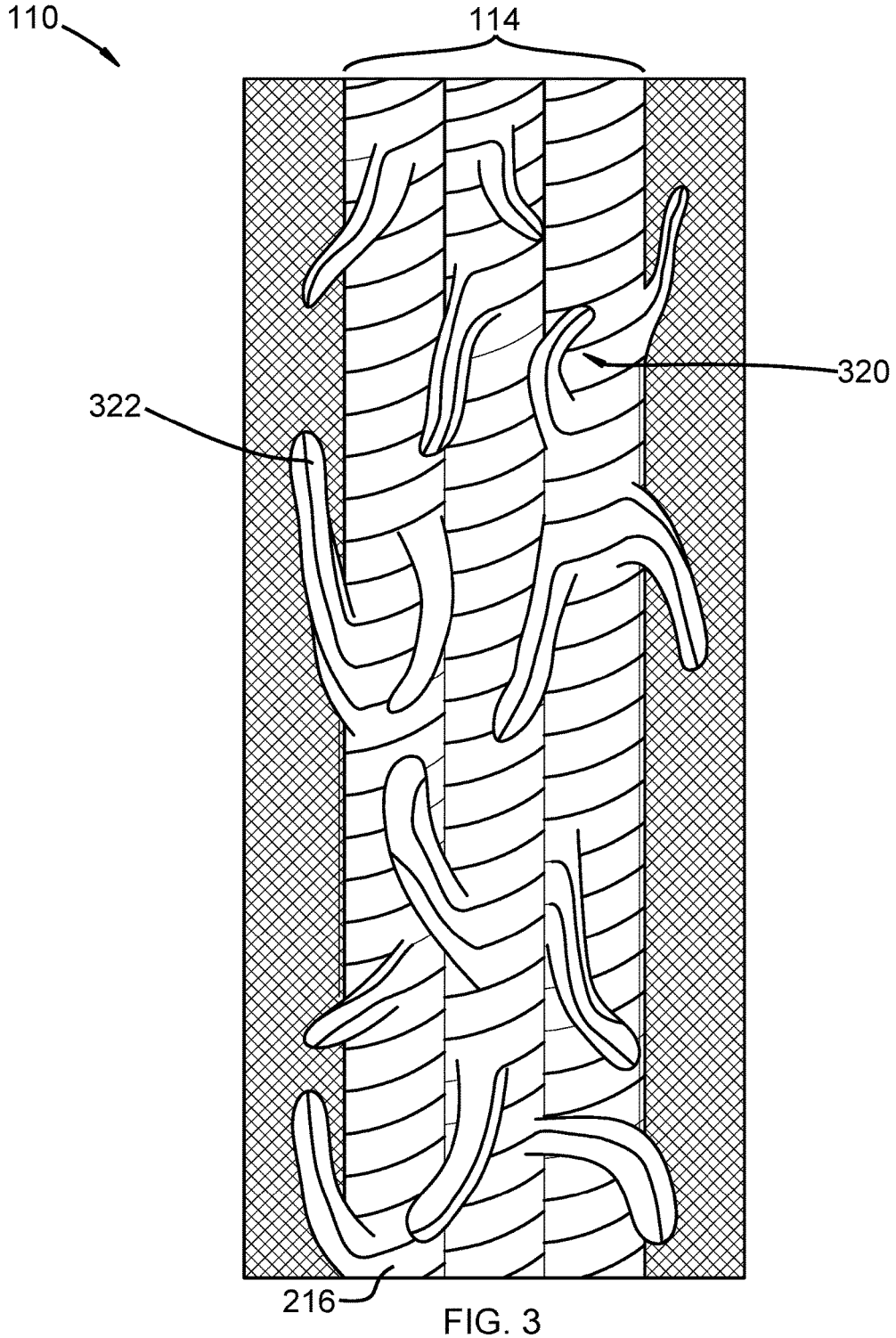
FIG. 3 is a sectional view of the rope of FIG. 2, according to one embodiment, depicting an inner core with a non-planar surface.

FIG. 3 is a sectional view of the rope 110 of FIG. 2, according to one embodiment, depicting an inner core 114 with a non-planar surface 320. An outer sheath 112 flanks the inner core 114. The non-planar surface 320 includes a plurality of protuberances 322 at least partially along its length. Such protuberances 322 may be of the same or a different material composition than the inner strands 216.

Figure 4:
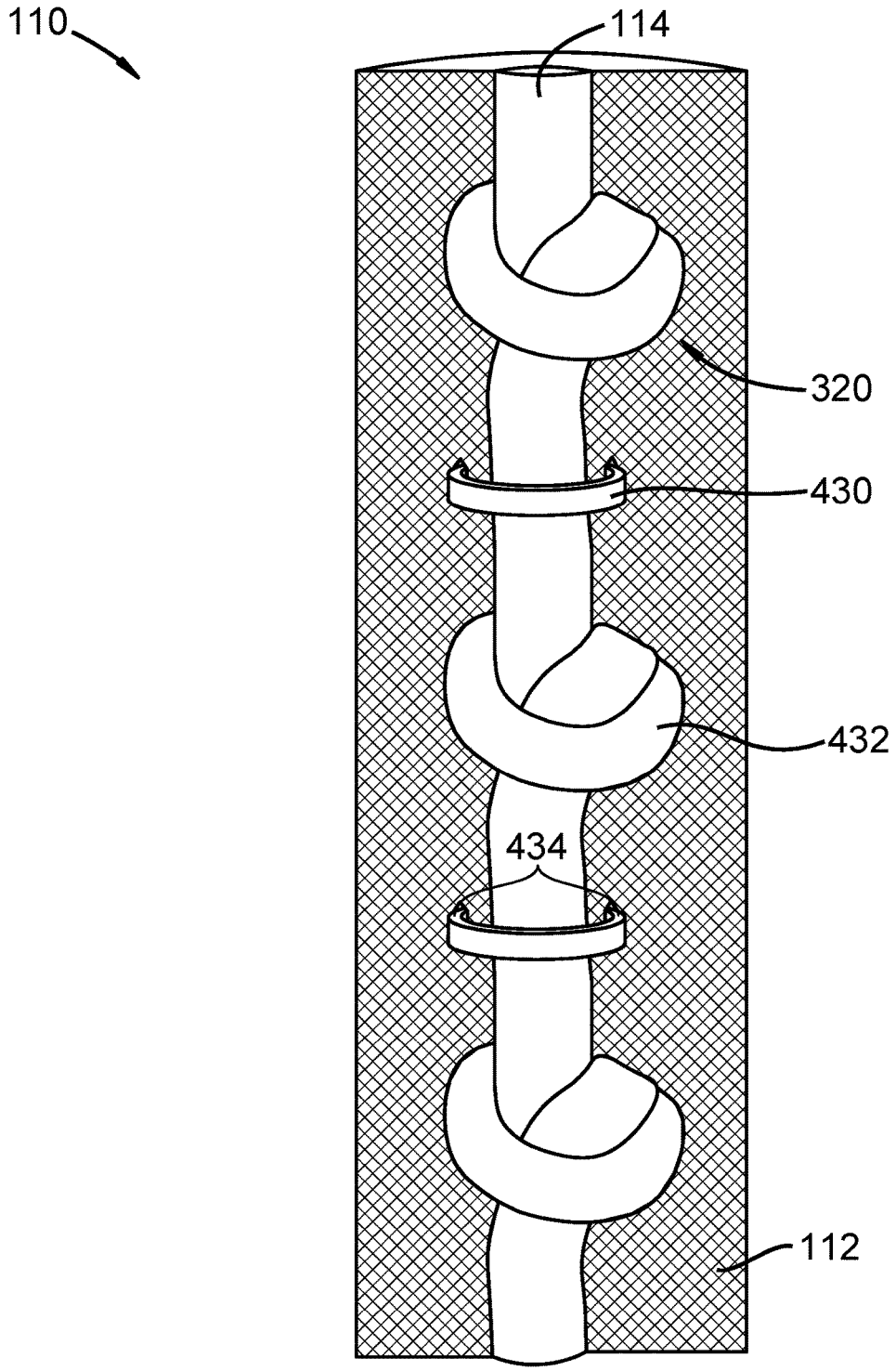
FIG. 4 is a sectional view of the rope of FIG. 2, according to one embodiment, depicting an inner core with a non-planar surface and rings connected to an outer sheath.

FIG. 4 is a sectional view of the rope 110 of FIG. 2, according to one embodiment, depicting an inner core 114 with a non-planar surface 320 and rings 430 connected to an outer sheath 112. The inner core 114 includes a plurality of knots 432 separated by the interconnected loops 430. The interconnected loops 430 may be of a small enough diameter 434 to prevent the knots 432 from passing through the rings 430.

Figure 5:
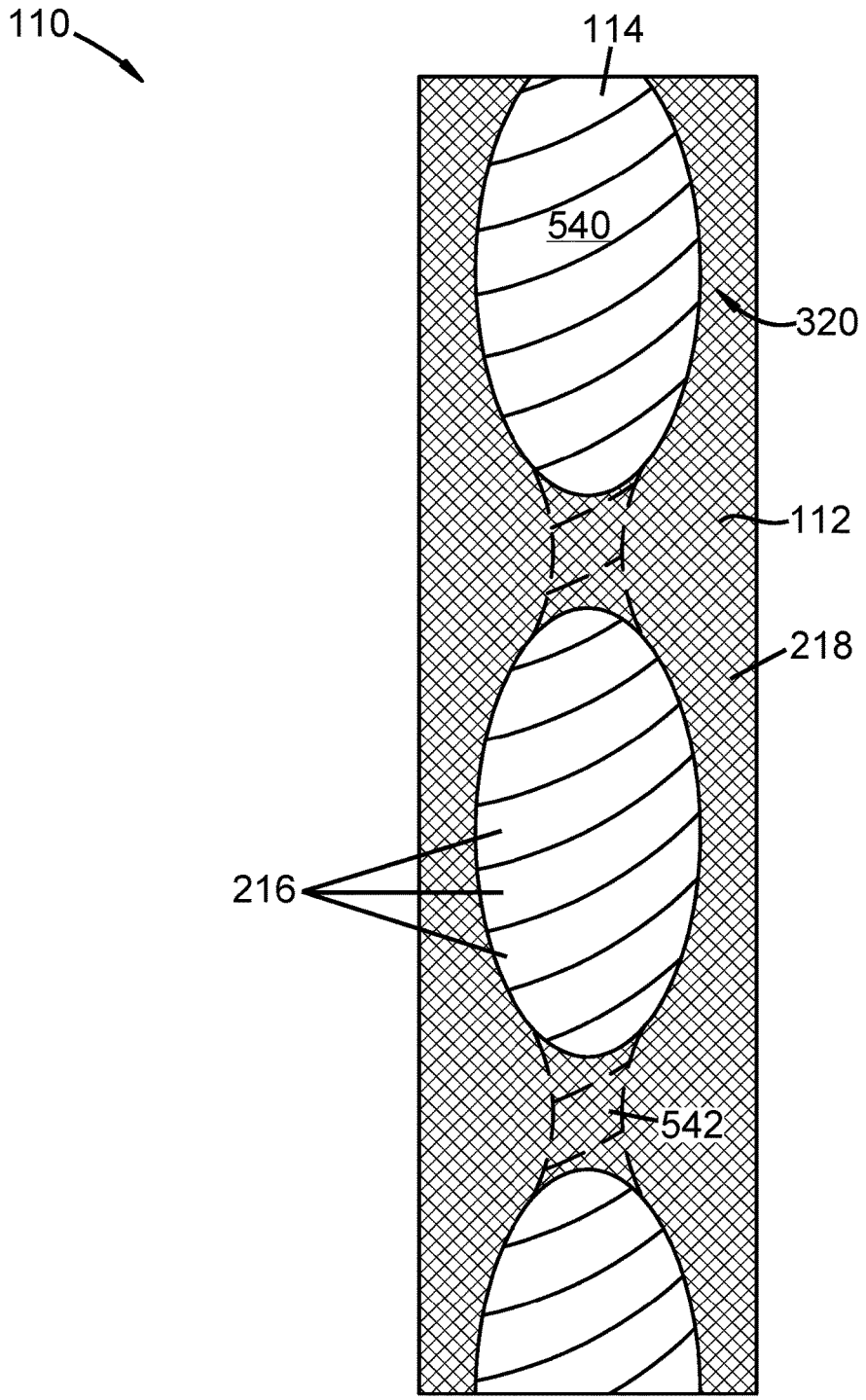
FIG. 5 is a sectional view of the rope of FIG. 2, according to one embodiment, depicting an inner core with a non-planar surface in interaction with an outer sheath.

FIG. 5 is a sectional view of the rope 110 of FIG. 2, according to one embodiment, depicting an inner core 114 with a non-planar surface 320 in interaction with an outer sheath 112. The inner core 114 may contain bulges 540 separated by compressions 542 in the outer sheath 112. The compressions 542 in the outer sheath 112 may be a result of the material of the outer sheath 112, or a commingling of inner strands 216 in the inner core 114 with strands 218 of the outer sheath 112.

Figure 6:
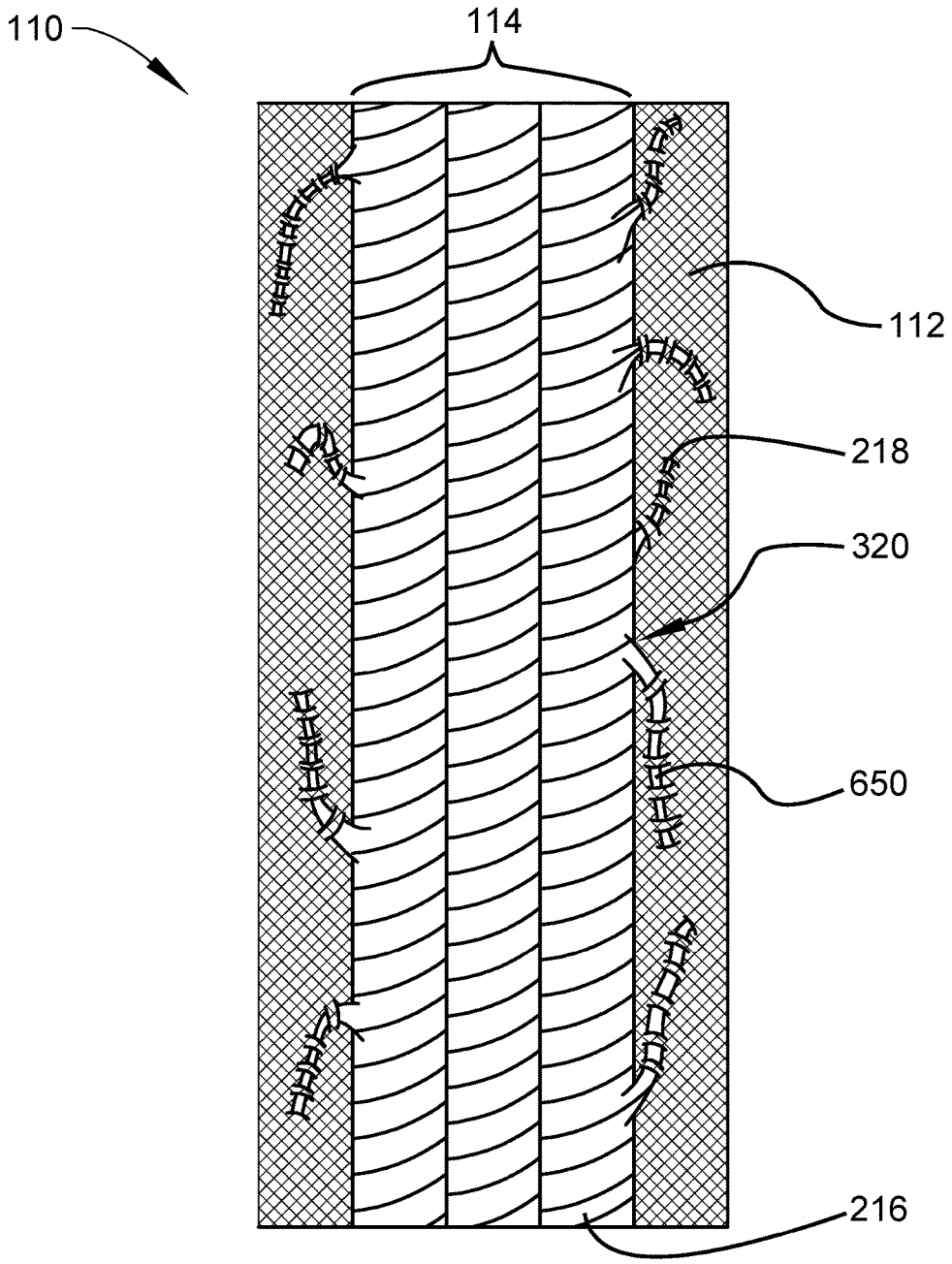
FIG. 6 is a sectional view of the rope of FIG. 2, according to one embodiment, depicting an inner core with a non-planar surface wherein inner strands are woven into an outer sheath

FIG. 6 is a sectional view of the rope 110 of FIG. 2, according to one embodiment, depicting an inner core 114 with a non-planar surface 320 wherein inner strands 216 are woven into an outer sheath 112. The inner strands 216 may be of the same continuous thread 650 as the braided strands 218 of the outer sheath 112. Alternatively, the inner strands 216 may be connected to the braided strands 218 by ties, knots, loops, twists, braids, weaves, or any combination thereof.

Reference throughout this specification to "an embodiment" or "the embodiment" means that a particular feature, structure or characteristic described in connection with that embodiment is included in at least one embodiment. Thus, the quoted phrases, or variations thereof, as recited throughout this specification are not necessarily all referring to the same embodiment.

Similarly, it should be appreciated that in the above description of embodiments, various features are sometimes grouped together in a single embodiment, figure, or description thereof for the purpose of streamlining the disclosure. This method of disclosure, however, is not to be interpreted as reflecting an intention that any claim requires more features than those expressly recited in that claim. Rather, as the following claims reflect, inventive aspects lie in a combination of fewer than all features of any single foregoing disclosed embodiment. Thus, the claims following this Detailed Description are hereby expressly incorporated into this Detailed Description, with each claim standing on its own as a separate embodiment. This disclosure includes all permutations of the independent claims with their dependent claims.

It will be apparent to those having skill in the art that changes may be made to the details of the above-described embodiments without departing from the underlying principles of the invention. Embodiments of the invention in which an exclusive property or privilege is claimed are defined as follows.

The invention claimed is:

1. A compressible rope, comprising:

a plurality of interconnected outer strands forming a sheath;

one or more inner strands forming an inner core encased by the sheath; and wherein the inner core comprises a non-planar outer surface that radially extends thereabout being in contact with each of the plurality of interconnected outer strands of the sheath.

2. The compressible rope of claim 1, wherein the strands are comprised of hemp, linen, flax, cellulose, carbon, wool, hair, feathers, cotton, coir, jute, straw, silk, sisal, polymers, nylon, Dyneema®, Kevlar®, rayon, orlon, polypropylene, polyesters, polyethylene, aramids, acrylics, copper, iron, steel, stainless steel, bronze, nichrome, carbon, solder, titanium, zinc, silver, gold, tungsten, or aluminum, or compounds or combinations thereof.

3. The compressible rope of claim 1, wherein the sheath is comprised of a plurality of tied, knotted, looped, twisted, braided, or woven outer strands, or combinations thereof.

4. The compressible rope of claim 1, wherein the sheath encases the core while the core is under tension.

5. The compressible rope of claim 1, wherein the plurality of outer strands are distributed uniformly for the entirety of the rope.

6. The compressible rope of claim 1, wherein the sheath comprises discontinuities at random or periodic locations along the length of the rope corresponding with or unrelated to any change in material composition of the sheath.

7. The compressible rope of claim 1, wherein the inner core comprises a single strand or a plurality of strands.

8. The compressible rope of claim 1, wherein the inner core comprises a monofilament or a polyfilament material or a combination thereof.

9. The compressible rope of claim 1, wherein one or more inner strands are tied, knotted, looped, twisted, braided, woven, or any combination thereof.

10. The compressible rope of claim 1, wherein the inner core is under tension after being encased by the sheath.

11. The compressible rope of claim 1, wherein the one or more inner strands are tied, knotted, looped, twisted, braided, or woven uniformly along the length of the core.

12. The compressible rope of claim 1, wherein the inner core comprises discontinuities at random or periodic locations along the length of the rope corresponding with or unrelated to any change in material composition of the inner core.

13. The compressible rope of claim 1, wherein the inner core comprises a roughened surface at least partially along its length.

14. The compressible rope of claim 1, wherein the non-planar surface comprises a plurality of undulations, spirals, depressions, perforations, excrescences, protrusions, protuberances, or papillae at least partially along its length.

15. The compressible rope of claim 1, wherein the non-planar surface occurs periodically, measuredly, irregularly, or sporadically along at least a portion of the inner core.

16. The compressible rope of claim 1, wherein the non-planar surface is comprised of a plurality of non-planar inconsistencies such as knots, bulges, swellings, or lumps at least partially along the length of rope.

17. The compressible rope of claim 1, wherein the inner core comprises one or more rings, loops, bands, or circles distributed intermittently along the length of the rope.

18. The compressible rope of claim 1, wherein the knots, bulges, swellings, or lumps comprise strands of relatively thicker material, tangled masses associated with knots, loosely woven strands, or combinations thereof.

19. The compressible rope of claim 1, wherein the sheath comprises one or more rings, loops, compressions, bands, or circles that are smaller in diameter than any non-planar inconsistencies located on the inner core, and are intermittently distributed along the length of the rope.

20. The compressible rope of claim 1, wherein the sheath and the inner core comprise a static or dynamic interaction such that there is a reduction in the occurrence of unintended bunching, untying, separating, or slipping between the sheath and the inner core at least partially along the length of the rope.

* * * * *